US005564917A

United States Patent [19]

Leyderman et al.

[11] Patent Number: 5,564,917

[45] Date of Patent: Oct. 15, 1996

[54] ROTARY COMPRESSOR WITH OIL INJECTION

[75] Inventors: Alexander D. Leyderman, Manlius; Martin M. Mertell, East Syracuse; Donald Yannascoli, Manlius, all of N.Y.

[73] Assignee: Carrier Corporation, Syracuse, N.Y.

[21] Appl. No.: 498,339

[22] Filed: Jul. 5, 1995

Related U.S. Application Data

[63] Continuation of Ser. No. 52,971, Apr. 27, 1993, abandoned.

[51] Int. Cl.[6] ..... F01C 1/02; F01C 21/04

[52] U.S. Cl. ..... 418/63; 418/97; 184/6.16

[58] Field of Search ..... 418/63, 97, 99; 417/907; 184/6.16

[56] References Cited

U.S. PATENT DOCUMENTS

| | | | |
|---|---|---|---|
| 2,646,206 | 7/1953 | Bräm | 418/97 |
| 2,991,931 | 7/1961 | Galin | 418/63 |
| 3,250,459 | 5/1966 | Brown et al. | 418/97 |
| 3,415,445 | 12/1968 | Fuentevilla et al. | 418/97 |
| 3,565,552 | 2/1971 | Modem et al. . | |
| 3,820,924 | 6/1974 | Cassidy | 418/97 |
| 3,904,321 | 9/1975 | Rüedi et al. | 418/97 |
| 4,331,002 | 5/1982 | Ladusaw . | |
| 4,983,108 | 7/1992 | Kawaguchi et al. | 418/63 |
| 4,997,350 | 3/1991 | Tamura et al. | 418/55.6 |

FOREIGN PATENT DOCUMENTS

| | | |
|---|---|---|
| 2223156 | 11/1973 | Germany . |
| 50-160816 | 12/1975 | Japan . |
| 52-112512 | 12/1976 | Japan . |
| 63-134192 | 2/1988 | Japan . |
| 399890 | 10/1991 | Japan . |

OTHER PUBLICATIONS

European Search Report—4 Aug. 1994, Examiner T. Kapoulas Application No. EP 94 63 0025.

*Primary Examiner*—Charles Freay

[57] ABSTRACT

In a high side rotary compressor, interior shell pressure is used to force lubricant from the sump into the compression chamber. The lubricant is delivered only after the suction port has closed and before chamber pressure exceeds shell pressure.

6 Claims, 3 Drawing Sheets

ROTARY COMPRESSOR WITH OIL INJECTION

This application is a Continuation of application Ser. No. 08/052,971, filed Apr. 27, 1993 now abandoned.

BACKGROUND OF THE INVENTION

In a fixed vane or rolling piston compressor, the vane is biased into contact with the roller or piston. The roller or piston is carried by an eccentric on the crankshaft and tracks along the cylinder in a line contact such that the piston and cylinder coact to define a crescent shaped space. The space rotates about the axis of the crankshaft and is divided into a suction chamber and a compression chamber by the vane coacting with the piston. In a vertical, high side compressor an oil pickup tube extends into the oil sump and is rotated with the crankshaft thereby causing oil to be distributed to the locations requiring lubricant. In the case of variable speed operation, for example, there may be an inadequate distribution of oil. An area of sensitivity to inadequate lubrication is the line contact between the vane and piston and can cause excessive wear.

SUMMARY OF THE INVENTION

In a high side vertical rolling piston compressor the interior of the shell is at discharge pressure and therefore the pressure over the oil sump is at discharge pressure. Between the beginning of the compression stroke and the beginning of the discharge stroke, the trapped volume defined by the cylinder, piston and vane goes from suction pressure to discharge pressure. Particularly in the case of variable speed compressors, the lubrication provided by the conventional centrifugal pump structure can vary with operating conditions. By providing fluid communication between the oil sump and the trapped volume, lubricant can be injected into the trapped volume to provide lubrication between the piston and vane. A tube extends below the surface of the sump and is connected to a passage in the pump end bearing which opens into the cylinder through a restricted opening such that the oil is atomized. The piston coacts with the opening to uncover the opening and thereby permit oil injection during a portion of the compression stroke but otherwise blocking flow.

It is an object of this invention to maintain a stable oil film between the piston and vane.

It is a further object of this invention to provide auxiliary lubrication in a high side compressor. These objects, and others as will become apparent hereinafter, are accomplished by the present invention.

Basically, discharge pressure acting on the oil sump delivers oil to the trapped volume and the piston coacts with the oil delivery passage to control the delivery of oil to the trapped volume.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
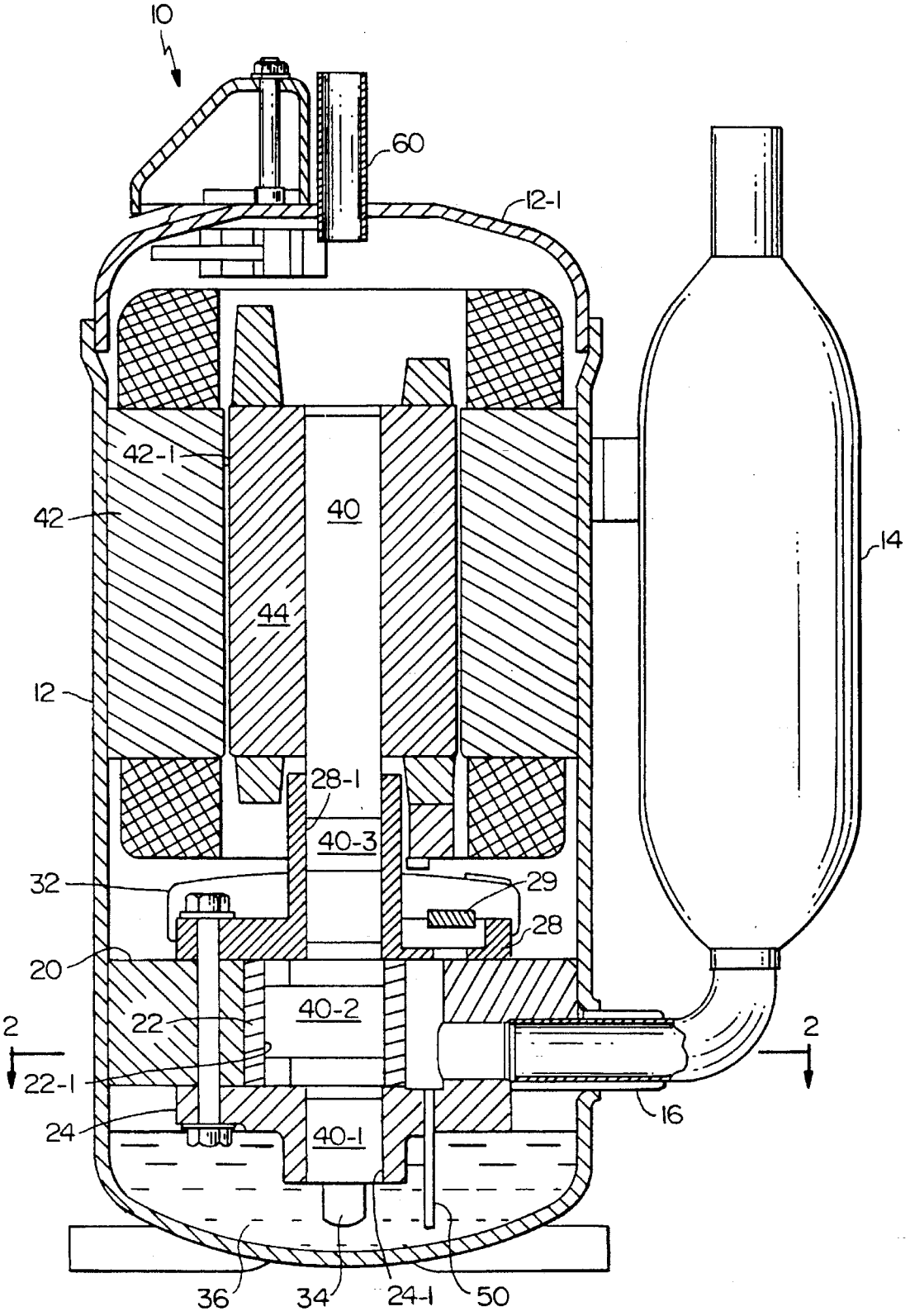
FIG. 1 is a partially sectioned view of a compressor employing the present invention.
Figure 2:
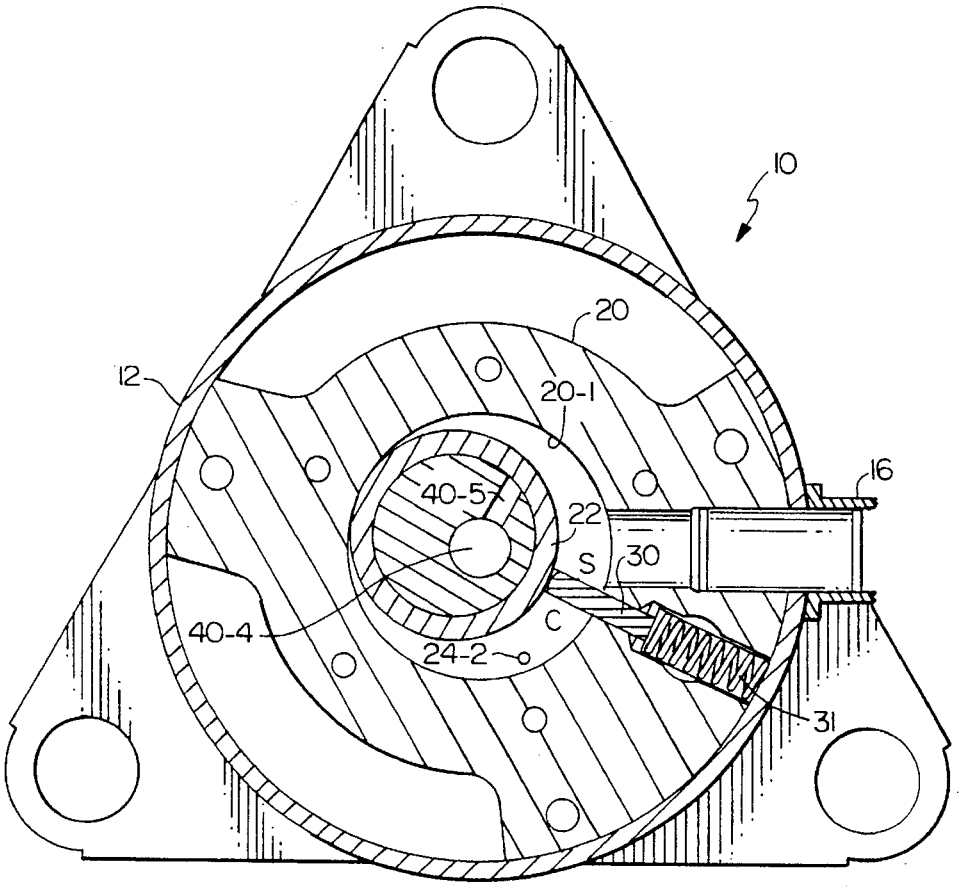
FIG. 2 is a sectional view taken along line 2—2 of FIG. 1.

In FIGS. 1 and 2, the numeral 10 generally designates a vertical, high side rolling piston compressor. The numeral 12 generally designates the shell or casing. Suction tube 16 is sealed to shell 12 and provides fluid communication between suction accumulator 14 in a refrigeration system and suction chamber S. Suction chamber S is defined by bore 20-1 in cylinder 20, piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define as variable speed motor. Vane 30 is biased into contact with piston 22 by spring 31. As described so far, compressor 10 is generally conventional.

Figure 3:
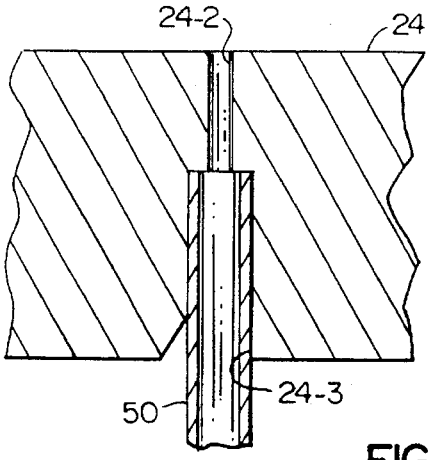
FIG. 3 is an enlarged view of the oil delivery structure.

The present invention adds machined oil injection port 242 which is preferably 0.5 go 1.3 mm in diameter. As best shown in FIG. 3, injection port 24-2 is connected to tube 50 which is received in bore 24-3 and extends beneath the level of sump 36. As will be explained in greater detail below, the oil injection port 24-2 is located such that piston 22 coacts therewith to open and close the injection port 24-2 during the compression cycle.

In operation, rotor 44 and eccentric shaft 40 rotate as a unit and eccentric 40-2 causes movement of piston 22. Oil from sump 36 is drawn through oil pick up tube 34 into bore 40-4 which may be skewed relative to the axis of rotation of shaft 40 and acts as a centrifugal pump. The pumping action will be dependent upon the rotational speed of shaft 40. As best shown in FIG. 2, oil delivered to bore 40-4 is able to flow into a series of radially extending passages, in portion 40-1, eccentric 40-2 and portion 40-3 exemplified by 40-5 in eccentric 40-2, to lubricate bearing 24, piston 22, and bearing 28, respectively. The excess oil flows from bore 40-4 and either passes downwardly over the rotor 44 and stator 42 to the sump 36 or is carried by the gas flowing from annular gap between rotor 44 and stator 42 and impinges and collects on the inside of cover 12-1 before draining to sump 36. Piston 22 coacts with vane 30 in a conventional manner such that gas is drawn through suction tube 16 to suction chamber S. The gas in suction chamber S is compressed and discharged via discharge valve 29 into the interior of muffler 32. The compressed gas passes through muffler 32 into the interior of shell 12 and pass via the annular gap between rotating rotor 44 and stator 42 and through discharge line 60 to the refrigeration system (not illustrated).

Figure 4A:
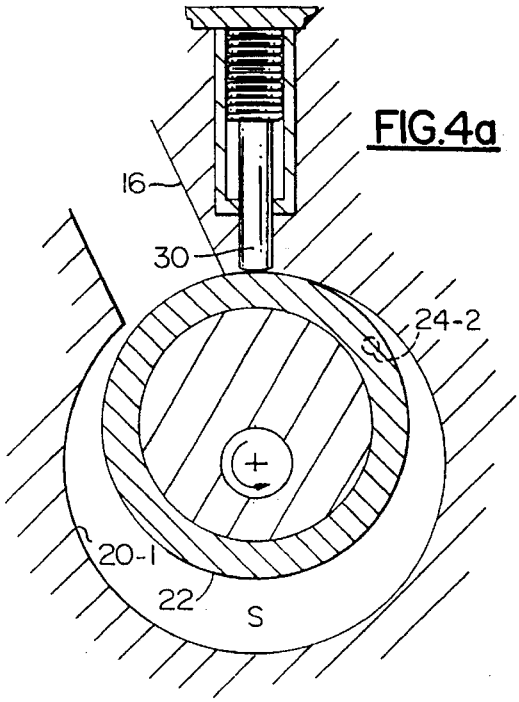
FIGS. 4A–D show the coaction of the piston with the oil delivery structure at 90° intervals.
Figure 4B:
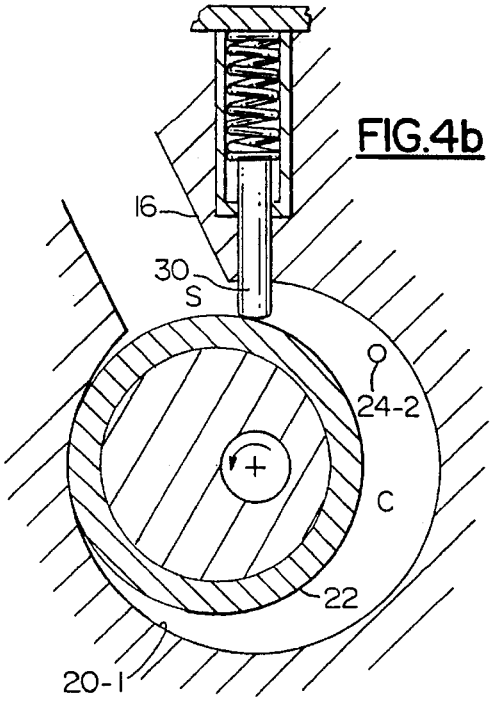
Figure 4D:
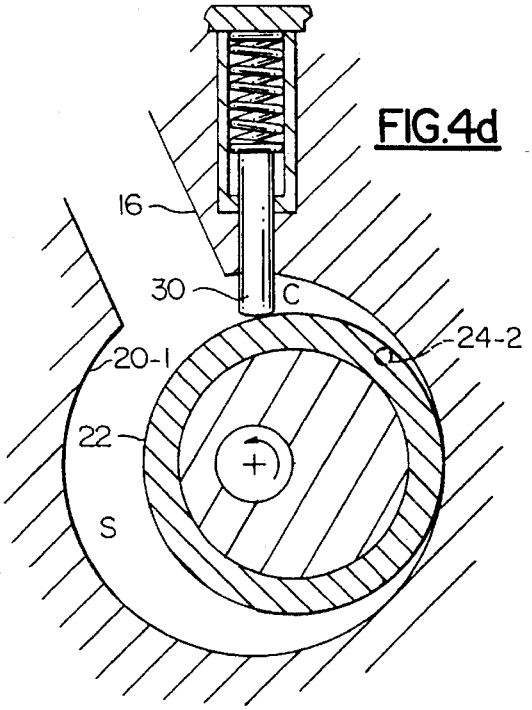
Figure 4C:
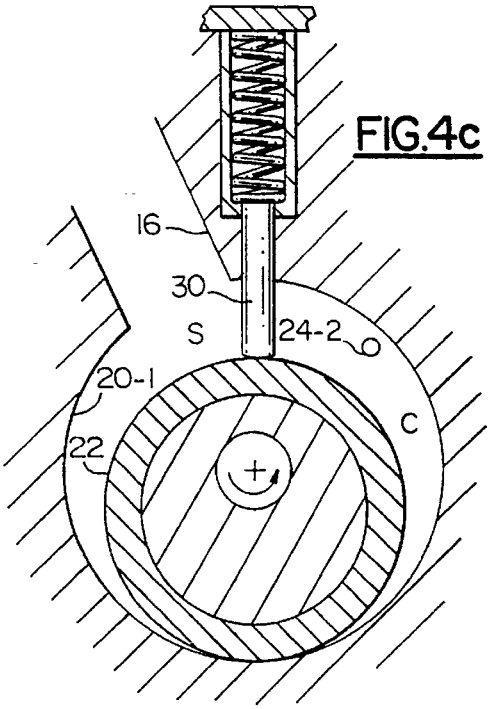

Referring now to FIG. 4A, it will be noted that suction chamber S makes up the entire crescent shaped space between piston 22 and bore 20-1 and marks the end of the compression process. In FIG. 4B, which is displaced 90° from FIG. 4A, the suction chamber of FIG. 4A has been cut off from suction tube 16 and has been transformed into a compression chamber C while a new suction chamber is being formed. FIG. 4C corresponds to FIGS. 1 and 2 and represents the mid-point in the compression process. FIG. 4D represents the later part of the suction and discharge processes which are each nominally completed in FIG. 4A.

At the beginning of each compression cycle which is best shown in FIG. 4B, the pressure in compression chamber C is less than the internal shell pressure which is acting on the sump 36. As a result, lubricant from sump 36 is forced into compression chamber C via tube 50 and oil injection port 24-2, if port 24-2 is uncovered, since the pressure acting on the sump 36 is greater than that in compression chamber C. The oil injected into the compression chamber via port 24-2 atomizes and disperses providing piston 22, vane 30 and the walls of bore 20-1 with a stable oil film. In comparing FIGS. 4A and 4B it is clear that oil injection port 24-2 is only opened after suction inlet is sealed off so that the full volume of refrigerant is present. Similarly, comparing FIGS. 4C and 4D, before the pressure in the compression chamber C exceeds the pressure in shell 12, piston 22 closes the oil injection port 24-2 and thereby prevents back flow.

Although the present invention has been illustrated and described in terms of a vertical, variable speed compressor, other modifications will occur to those skilled in the art. For example, the invention is applicable to horizontal compressors with the only change need in adapting a convention horizontal compressor is to locate tube 50 in the displaced sump. Similarly the motor need not be a variable speed motor. It is therefore intended that the present invention is to be limited only by the scope of the appended claims.

What is claimed is:

1. A high side rotary compressor comprising:

shell means having a first end and a second end;

cylinder means containing pump means including a vane and a piston coacting with said cylinder means to define suction and compression chambers;

said cylinder means being fixedly located in said shell means near said first end and defining with said first end a first chamber which has an oil sump located at the bottom thereof;

first bearing means secured to said cylinder means and extending towards said oil sump;

second bearing means secured to said cylinder means and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston;

said rotor means secured to said shaft means so as to be integral therewith and located within said stator so as to define therewith an annular gap;

suction means for supplying gas to said pump means;

discharge means fluidly connected to said shell means;

an oil injection port opening into said compression chamber;

oil delivery means extending from said oil sump to said oil injection port for delivering oil from said sump to said injection port solely due to pressure in said shell means acting on said oil sump;

said piston coacting with said injection port to permit delivery of oil only to said compression chamber for a portion of each compression cycle.

2. The compressor of claim 1 wherein said oil injection port is located in said first bearing means.

3. The compressor of claim 1 wherein said compressor is vertical compressor.

4. The compressor of claim 1 wherein said motor means is a variable speed motor.

5. The compressor of claim 1 further including;

oil distribution means formed in said shaft means; and means for supplying oil to said oil distribution means.

6. The compressor of claim 1 wherein said oil injection port is 0.5 to 1.3 mm in diameter.

* * * * *